US010294724B2

(12) United States Patent
Rantala et al.

(10) Patent No.: US 10,294,724 B2
(45) Date of Patent: May 21, 2019

(54) ROCK DRILL

(71) Applicant: SANDVIK MINING AND CONSTRUCTION OY, Tampere (FI)

(72) Inventors: Esa Rantala, Tampere (FI); Timo Muuttonen, Tampere (FI); Ari Kotala, Tampere (FI); Pekka Saukko, Tampere (FI)

(73) Assignee: Sandvik Mining and Construction OY, Tampere (FI)

( * ) Notice: Subject to any disclaimer, the term of this patent is extended or adjusted under 35 U.S.C. 154(b) by 171 days.

(21) Appl. No.: 15/629,074

(22) Filed: Jun. 21, 2017

(65) Prior Publication Data

US 2017/0370150 A1 Dec. 28, 2017

(30) Foreign Application Priority Data

Jun. 22, 2016 (EP) ..... 16175645

(51) Int. Cl.

| | |
|---|---|
| ***E21B 1/00*** | (2006.01) |
| ***E21B 7/02*** | (2006.01) |
| ***E21B 1/02*** | (2006.01) |

(52) U.S. Cl.

CPC ..... *E21B 7/022* (2013.01); *E21B 1/02* (2013.01); *E21B 7/025* (2013.01)

(58) Field of Classification Search

CPC ..... E21B 7/022; E21B 7/025; E21B 1/02

See application file for complete search history.

(56) References Cited

U.S. PATENT DOCUMENTS

2011/0220421 A1* 9/2011 Muuttonen ..... B25D 9/14 175/293

FOREIGN PATENT DOCUMENTS

| | | | |
|---|---|---|---|
| WO | 03044319 | A1 | 5/2003 |
| WO | 2007073275 | A1 | 6/2007 |
| WO | 2014070072 | A1 | 5/2014 |
| WO | 2015122824 | A1 | 8/2015 |

* cited by examiner

*Primary Examiner* — Brad Harcourt

(74) *Attorney, Agent, or Firm* — Corinne R. Gorski

(57) ABSTRACT

A rock drill includes a frame, a percussion member, an axial shank, and an axial sleeve provided within the frame and including a first pressure surface provided in a first pressure space and a second pressure surface provided in a second pressure space. A first channel is provided in the axial sleeve for providing a connection between the first pressure space and the second pressure space in at least one position of the axial sleeve in the frame. A second pressure channel connected to the second pressure space is connectable to external pressure. A pressure accumulator is connected to the first pressure space and the flow of the pressure medium outwards from the first pressure space is throttled.

12 Claims, 5 Drawing Sheets

ROCK DRILL

RELATED APPLICATION DATA

This application claims priority under 35 U.S.C. § 119 to EP Patent Application No. 16175645.7, filed on Jun. 22, 2016, which the entirety thereof is incorporated herein by reference.

BACKGROUND

The present disclosure relates to a rock drill, and more particularly to a rock drill having a frame, a percussion member, a shank and an axial sleeve.

It is known to use an axial sleeve in a rock drilling machine for moving the shank to the intended percussion point during drilling and for adjusting the percussion power by adjusting the position of the shank. On the other hand, the axial sleeve can be used to dampen stress pulses reflected from the rock back to the drilling machine.

Many problems are associated with different arrangements available in the market. They do not provide sufficient dampening of stress pulses reflected from the rock, they require external pressure control and/or they cause problems for rattling threads of drill rods open.

SUMMARY

To overcome the above disadvantages, the present disclosure is directed to a novel and improved rock drill.

An idea of the disclosed solution is that the rock drill includes a first pressure channel connected to a first pressure space provided in an axial direction on the side of the shank in relation to the axial sleeve, a pressure accumulator connected to the first pressure channel and that flow of the pressure medium outwards from the first pressure space is throttled by throttling the flow of the pressure medium from the first pressure space to the tank and/or the pressure lower than that of the external pressure connected to the second pressure space.

An aspect of the disclosed solution is that in the solution the axial sleeve provides a continuous support for the shank and the solution also provides good dampening of the reflection back from the rock to the drilling machine when the tool hits the rock. Additionally, the solution provides without external control a simple automatic rock drill internal control of the functional state change between drilling, during which a continuous support from the axial sleeve to the shank is needed, and rattling, in other words hitting/rattling the threads of the drill rod open, during which the axial sleeve should be kept from contacting the shank.

BRIEF DESCRIPTION OF THE DRAWINGS

In the Following the Invention Will be Described in Greater Detail by Means of Preferred Embodiments with Reference to the Attached Drawings, in which.

DETAILED DESCRIPTION

General structures and working principles of pressure-medium-operated rock drills used for percussive drilling are well known in the art. Therefore, they are not explained in more detail in this description. The figures are provided for illustrating the principles of the current solution. For the sake of clarity, not all necessary bearings, seals and ducts and other structural parts of a rock drilling rig and rock drill are shown in the figures, for example.

Figure 10:
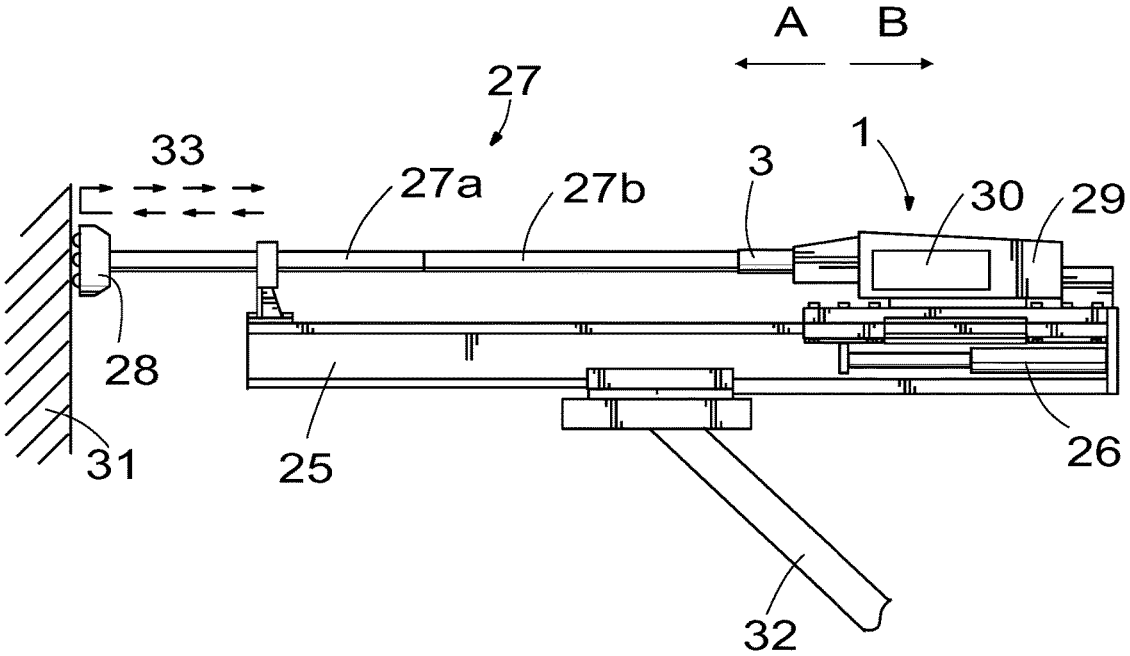
FIG. 10 is a schematic side view of a rock drill.

FIG. 10 is a schematic side view of a rock drill 1. The rock drill 1 is arranged movable relative to a feed beam 25. The feed beam 25 may be arranged at the free end of a boom 32 of a rock drilling rig (not shown), for example. The rock drill 1 is movable on the feed beam 25 by means of a feeding device 26. The rock drill 1 include a shank 3 to which necessary drilling equipment 27 composed of one or more drill rods 27*a*, 27*b*, and a tool such as a drill bit 28, for example, can be connected. The rock drill 1 has a percussion device 29 for generating percussion pulses in the shank 3 through a percussion member 2. In addition, the rock drill 1 typically has a rotating device 30 for rotating the shank 3 around its longitudinal axis. The shank 3 transfers percussion, rotational and feeding forces to the drilling equipment 27, which transfers them further to a rock 31 to be drilled.

Figure 1:
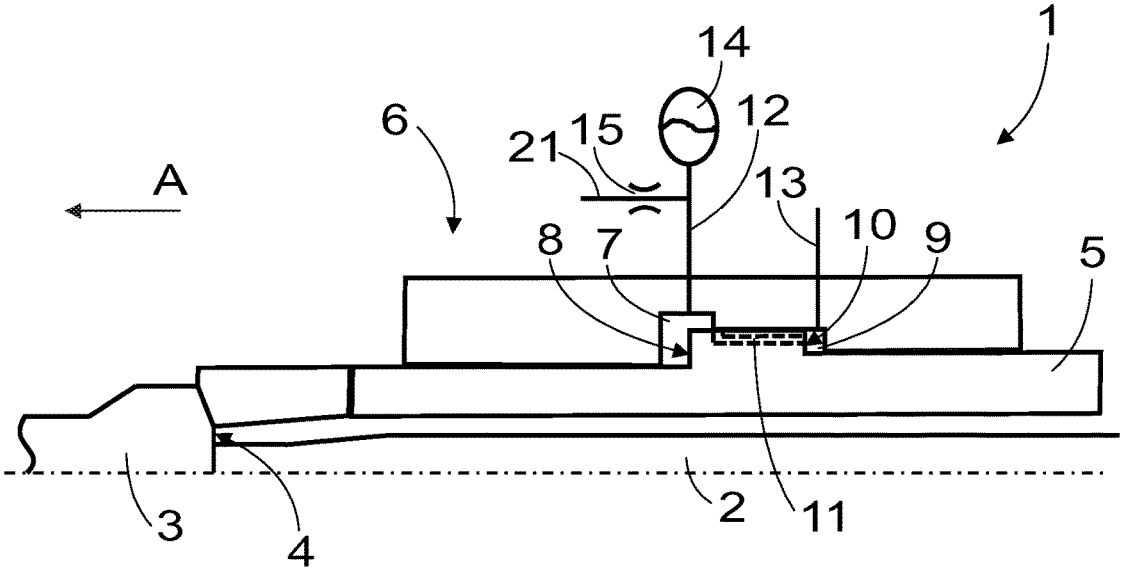
FIG. 1 illustrates a detail of a rock drill according to an embodiment.

FIG. 1 illustrates a detail of a rock drill according to an embodiment. The rock drill 1 may include a frame 6 composed of one or more interconnected frame parts, a percussion member 2 and an axial shank 3. The percussion member may be arranged to move axially by the action of a pressure medium to generate impact pulses by directing pressure medium to act on working pressure surface(s) (not shown) of the percussion member 2, such as a percussion piston or a transmission piston, whereby the pressure medium may act on the percussion member 2 in impact and return directions. The impact direction is marked by reference A and the return direction is the direction opposite to the impact direction.

The shank 3 may be provided on the front side of the percussion member 2 in the direction of the impact A. In other words, the shank 3, and in particular an impact surface 4 of the shank 3, may be arranged to receive the impact pulses. The shank 3 may then further transmit the impact pulse to a tool, such as a drill bit 28. The impact pulse may include for instance a strike provided by kinetic energy of a percussion piston or a stress pulse provided by a transmission piston compressing the tool in its longitudinal direction. According to an embodiment, the axial shank 3 may include an integral drill rod. In other words, in such an embodiment the impact surface 4 receiving the impact pulses from the percussion member 2 may be arranged on the integral drill rod instead of a separate shank structure. Otherwise, this kind of an embodiment may be similar to an embodiment described in this description and comprising a separate shank structure or a combination of such embodiments.

The rock drill 1 may further include an axial sleeve 5 provided within the frame 6. More particularly, the percussion member 2, the shank 3 and the axial sleeve 5 may be provided within a space provided inside the frame 6 of the rock drill 1. The axial sleeve 5 may be used for moving the shank 3 to the intended percussion point during drilling and for adjusting the percussion power by adjusting the position of the shank 3, as well as for dampening stress pulses reflected from the rock back to the drilling machine when the tool is brought into contact with the rock to be drilled. FIG. 10 illustrates the reflected stress pulse with arrows 33. The axial sleeve 5 may also act as an axial bearing in the rock drill 1.

The axial sleeve 5 may include a first pressure surface 8 provided in a first pressure space 7 and a second pressure surface 10 provided in a second pressure space 9. The first pressure space 7 may be provided in an axial direction on the side of the shank 3 in relation to the axial sleeve 5 and the second pressure space 9 is provided in an axial direction on the side of the axial sleeve 5 opposite to that of the shank 3. Thereby the first pressure surface 8 of the axial sleeve 5 may be facing towards the shank 3 and the second pressure surface 10 may be facing away from the shank 3.

Pressure medium fed to the first and second pressure spaces 7, 9 may be arranged to act on the first pressure surface 8 and/or on the second pressure surface 10 for moving the axial sleeve 5 in the axial direction. The pressure medium may, thus, be arranged to act on one or both the first and the second pressure surface 8, 10 at the same time or in turns. Thereby, the axial sleeve 5 may have different position in relation to the frame 6 during a work cycle of the rock drill 1. A first channel 11 may be provided in the axial sleeve 5, which first channel 11 provides a connection between the first pressure space 7 and the second pressure space 9 in at least one position of the axial sleeve 5 in the frame 6, in other words in at least one position of the axial sleeve 5 in relation to the frame 6.

According to an embodiment, during drilling, the rock drill 1 is pushed forward in the impact direction A by a feeding force that is larger than balancing the momentum of the strikes. The difference between these forces causes the shank 3 to push the axial sleeve 5 backwards, in other words in return direction B. Thereby, the position of the axial sleeve 5 in relation to the frame 6 opens and closes the first channel 11 in such a manner, that the pressure medium in the first pressure space 7 acts the first pressure surface 8 with such a force that the axial sleeve 5 is kept in its position by a force that is a resultant of the force acting on the second pressure surface 10 and pushing the axial sleeve 5 forward in impact direction A and of the force acting on the first pressure surface 8 and pushing the axial sleeve 5 backwards in return direction B. When the forces change, the axial sleeve 5 moves by a small distance in relation to the frame 6, whereby the first channel 11 opens slightly more or less, which affects the pressure in the first pressure space 7 and, thereby, the force acting on the first pressure surface 8 changes keeping the resultant force between the forces pushing the axial sleeve 5 forward and backwards stable.

The rock drill 1 may further include a second pressure channel 13 connected to the second pressure space 9. The second pressure channel 13 may be connectable to external pressure, thus connecting the second pressure space 9 to the external pressure through the second pressure channel 13. The second pressure channel 13 may be provided at least partly in the frame 6.

The rock drill 1 may further include a pressure accumulator 14 connected to the first pressure space 7. The accumulator may use any accumulator known, as such for use in connection with pressure medium driven systems.

The flow of the pressure medium outwards from the first pressure space 7 may be throttled. Thereby, an improved control regarding the operation of the rock drill may be provided at the same time when the accumulator keeps pressure more stable than in known solution.

According to an embodiment, the rock drill 1 may further include a first pressure channel 12 connected to the first pressure space 7. The first pressure channel may be provided at least partly in the frame 6. The first pressure channel 12 may extend between the first pressure space 7 and the pressure accumulator 14.

Figure 9:
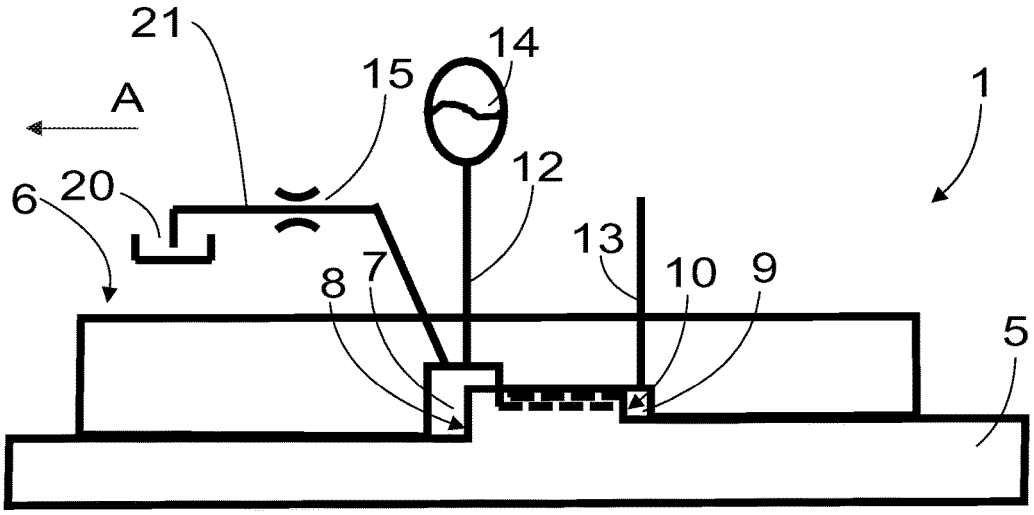
FIG. 9 illustrates a detail of a rock drill according to a ninth embodiment.

According to an embodiment, the rock drill 1 may further include a fourth pressure channel 21 connected to the first pressure space 7 directly, such as in the embodiment of FIG. 9, or indirectly, such as via the first pressure channel 12. The fourth pressure channel 21 may be provided with a first throttle 15 for throttling the flow of the pressure medium outwards from the first pressure space 7. This is the embodiment illustrated in FIG. 1. According to a further embodiment, the first throttle 15 may be adjustable to control the amount of pressure medium flowing through the first throttle 15, such as shown for instance in FIG. 3. This further improves the control over the operation of the axial sleeve 5 and the rock drill 1 as a whole and the versatility of the operation. According to an embodiment, the area of the second pressure surface 10 may be smaller in size than the area of the first pressure surface 8. This enables an improved control of an even more versatile movement, positioning and percussion power of the shank 3 and the rock drill 1 as a whole. Thereby, in situations where there is no feeding force pushing the frame 6 towards the shank 3, the axial sleeve 5 stays in the percussion point and doesn't push the shank 3 forward. This is particularly beneficial when the threads of the drill rod 27*a*, 27*b* are rattled open, since no external control, such as switching an external control pressure on/off, is needed to control the functional states of drilling and rattling the threads open, for example.

According to an embodiment, when the threads of the drill rod 27*a*, 27*b* are rattled open, the rock drill 1 is pushed forward in a horizontal position by a feeding force that is only sufficient for balancing the momentum of the strikes. Thereby, the feeding force does not push the rock drill 1 forward and the shank 3 does not push the axial sleeve 5 backwards. In such conditions a sufficient amount of pressure medium flows from the second pressure space 9 through the first channel 11 to the first pressure space 7 and, on the other hand, to the pressure accumulator 14 to provide by the pressure medium in the first pressure space 7 and in the second pressure space 9 forces acting on the first pressure surface 8 and the second pressure surface 10, respectively, that are equal to one another but acting on opposite directions A and B. Thereby, the axial sleeve 5 is kept in place without pushing the shank 3 forward. In a balance situation the position of the axial sleeve 5 with respect to the frame 6 is such that the first channel 11 is at least partly open and an equal volume of pressure medium flow takes into the first pressure space 7 through the first channel 11 and outwards from the first pressure space 7 through throttling, whereby the pressures and the pressure medium flow stay unchanged.

According to an embodiment, the pressure accumulator 14 enables fast movements, whereby the axial sleeve 5 dampens the stress pulses 33 reflected from the rock 31 back to the drilling machine. During drilling, when the percussion member 2 generates an impact pulse to the shank 3 the percussion member 2 hits the shank 3 forward. The axial sleeve 5 then has pushing force that starts to move the axial sleeve 5 forward, in other words in the impact direction A, whereby the volume of pressure medium displaced from the first pressure space 7 is directed to the pressure accumulator 14. According to an embodiment, the throttling of the flow of the pressure medium outwards from the first pressure space 7, the areas of the first pressure surface 8 and the second pressure surface 10, as well as the capacity and the pre-charge pressure of the pressure accumulator 14, and in some embodiments also a second throttle 17 in the second pressure channel 13 and/or a non-return valve 18, are dimensioned in such a manner that the axial sleeve 5 is in contact with the shank 3 before the reflected stress pulse 33 is received by the shank 3, whereby the reflected stress pulse 33 is transmitted to the axial sleeve 5. The axial sleeve 5 thereby moves backwards, in other words in the return direction B, whereby the pressure medium volume displaced to the pressure accumulator 14 returns to the first pressure space 7.

The current solution thus enables solving the problem of many known solutions where the axial sleeve tends to push the shank 3 forward thereby making it difficult or impossible to rattle drill rod threads open in this manner without additional arrangements.

According to an embodiment, the flow of the pressure medium outwards from the first pressure space 7 may be throttled by dimensioning a clearance between the axial sleeve 5 and the frame 6 to throttle the leakage flow between the axial sleeve 5 and the frame 6. This clearance and, thus, throttling may be provided on an area towards the shank 3 or an area towards the second pressure space 9 from the first pressure space 7, as will be explained in connection with some related embodiments.

Figure 2:
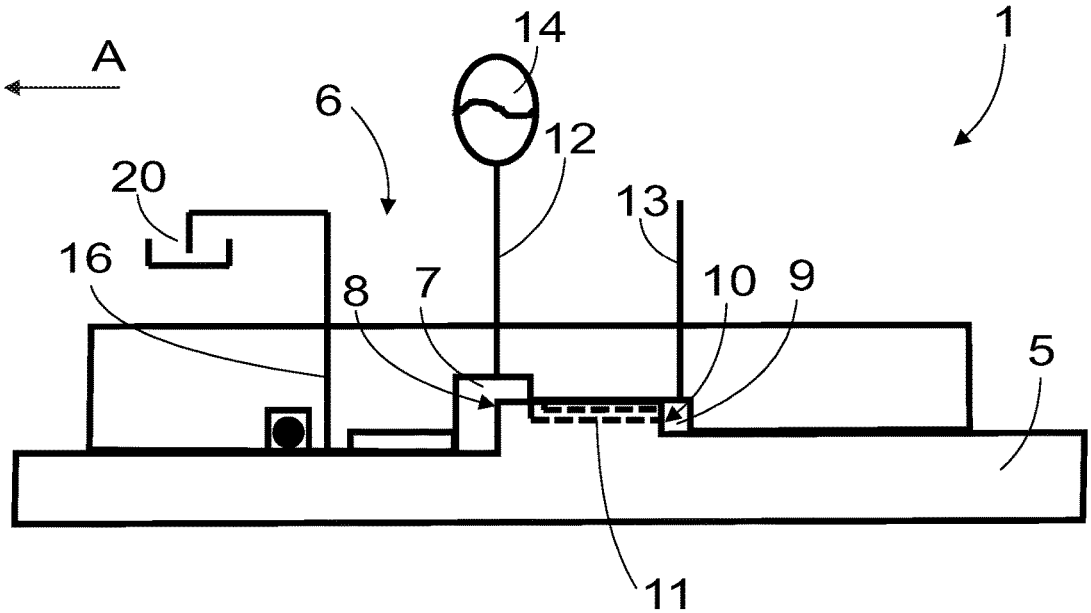
FIG. 2 illustrates a detail of a rock drill according to a second embodiment.

FIG. 2 illustrates a detail of a rock drill according to a second embodiment. According to this embodiment, a third pressure channel 16 may be connected on a side of the axial sleeve 5 to the direction of the shank 3 from the first pressure space 7 for leakage flow taking place through the clearance between the axial sleeve 5 and the frame 6. The flow of the pressure medium outwards from the first pressure space 7 may then be throttled by dimensioning the clearance between the axial sleeve 5 and the frame 6 to throttle the leakage flow between the axial sleeve 5 and the frame 6. In such an embodiment, a separate throttle is thus not necessary for throttling the flow of the pressure medium outwards from the first pressure space 7.

Figure 3:
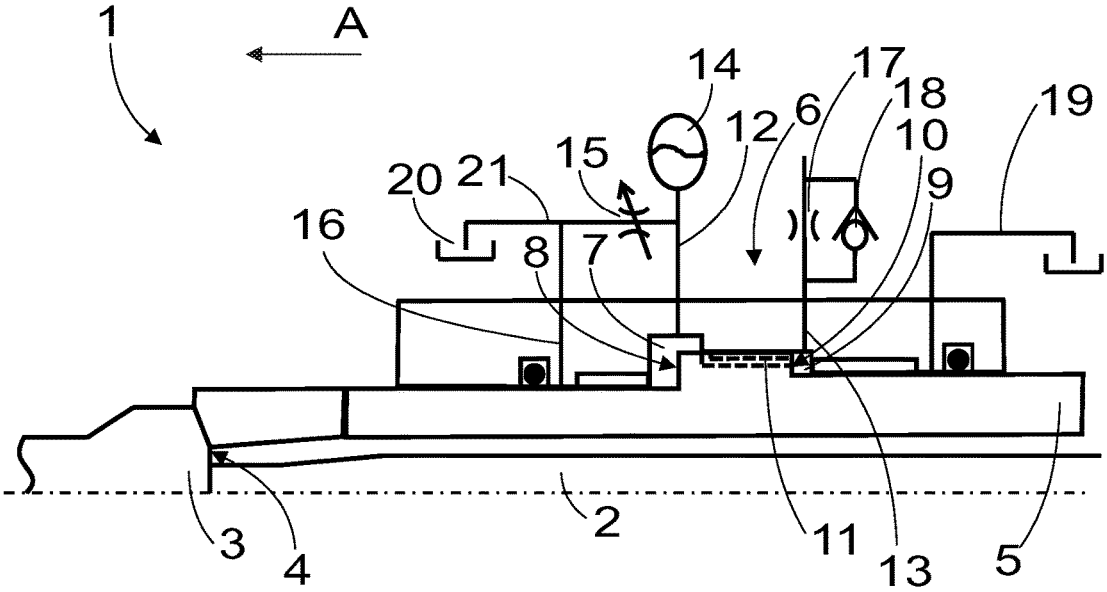
FIG. 3 illustrates a detail of a rock drill according to a third embodiment.

FIG. 3 illustrates a detail of a rock drill according to a third embodiment. It is clear for a person skilled in the art that although this embodiment combines several features and their combinations described above and below, a different embodiment might only have one or some of the features and feature combinations in line with what is described in the description hese features being dependent of one another or being only usable as a combination. According to an embodiment, the third pressure channel 16 may be connected to a fourth pressure channel 21. According to an embodiment, the second pressure channel 12 may be connected to the fourth pressure channel 21. Such an embodiment may or may not have a third pressure channel 16.

According to an embodiment, a second throttle 17 may be provided in the second pressure channel 13. According to an embodiment, the second throttle 17 may be adjustable to control the amount of pressure medium flowing through the throttle. According to a further embodiment, a non-return valve 18 may be provided in the second pressure channel 13 connected and in parallel with the second throttle 17, such that the non-return valve 18 enables flow of the pressure medium in to the second pressure space 9 but not outwards from the second pressure space 9. Thereby flow of the pressure medium outwards from the second pressure space 9 can only take place through the second throttle 17. In other words, flow of the pressure medium to the second pressure space 9 is not throttled, but the flow of the pressure medium outwards from the second pressure space 9 is throttled.

According to an embodiment, a sixth pressure channel 19 may be provided in the frame 6 on an area on the opposite side of the second pressure space 9 in relation to the first pressure space 7 and the shank 3. The sixth pressure channel 19 may be used to direct leakage flow between the axial sleeve 5 and the frame 6 backwards from the second pressure space 9 to a tank or to a pressure lower than the external pressure provided to the second pressure space 9.

Figure 4:
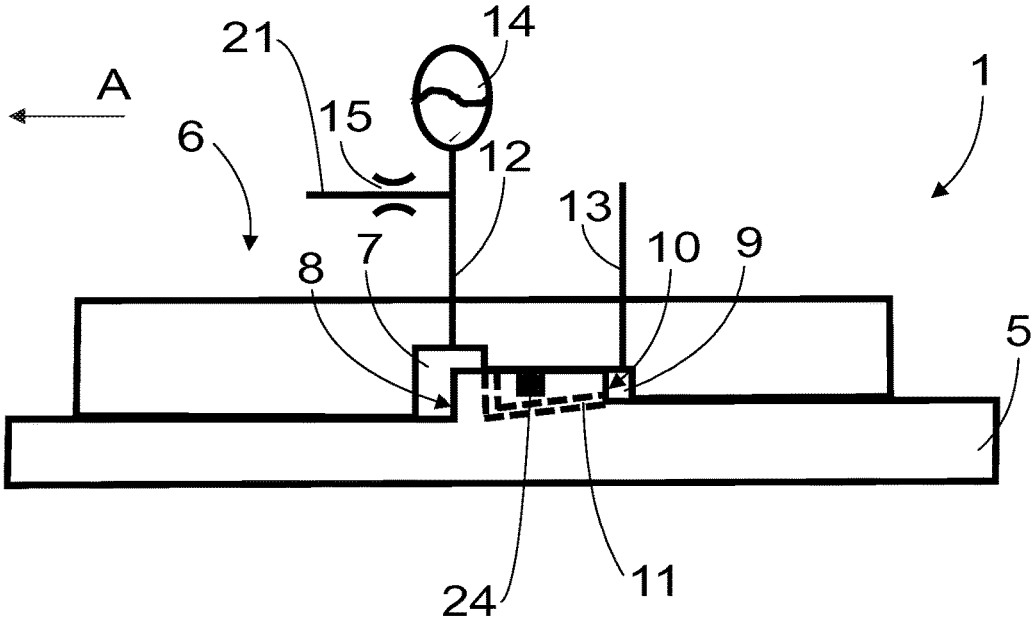
FIG. 4 illustrates a detail of a rock drill according to a fourth embodiment.
Figure 5:
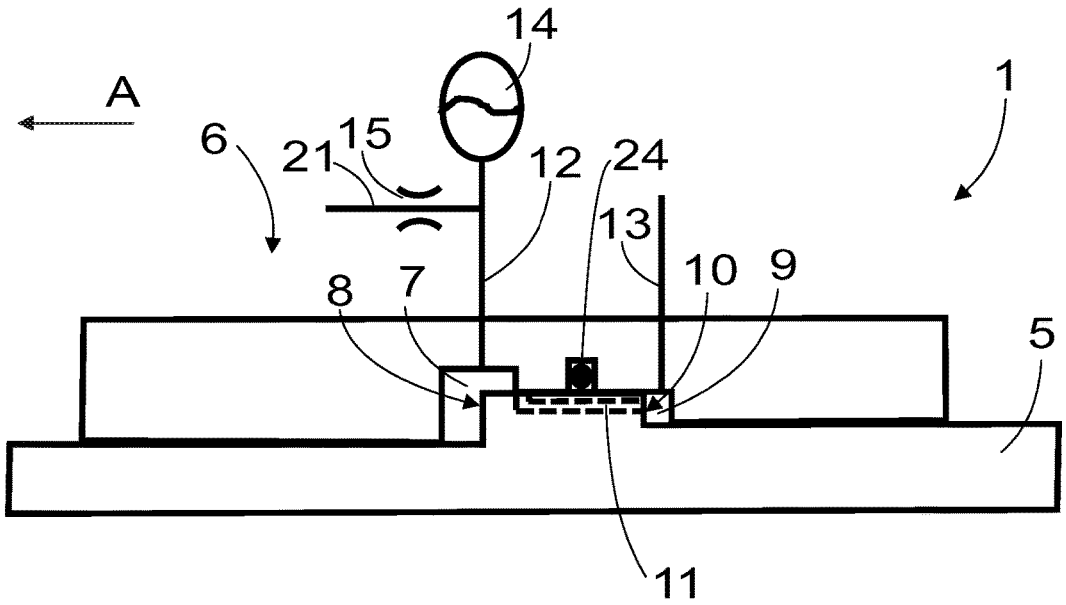
FIG. 5 illustrates a detail of a rock drill according to a fifth embodiment.

FIGS. 4 and 5 illustrate details of a rock drill according to a fourth and a fifth embodiment, respectively. In such embodiments, a seal 24 may be provided in the axial sleeve 5, such as in FIG. 4, or in the frame 6, such as in FIG. 5, on an area between the first pressure space 7 and the second pressure space 9 to prevent leakage flow from the second pressure space 9 to the first pressure space 7 or vice versa, in other words in the opposite direction from the first pressure space 7 to the second pressure space 9.

Figure 6:
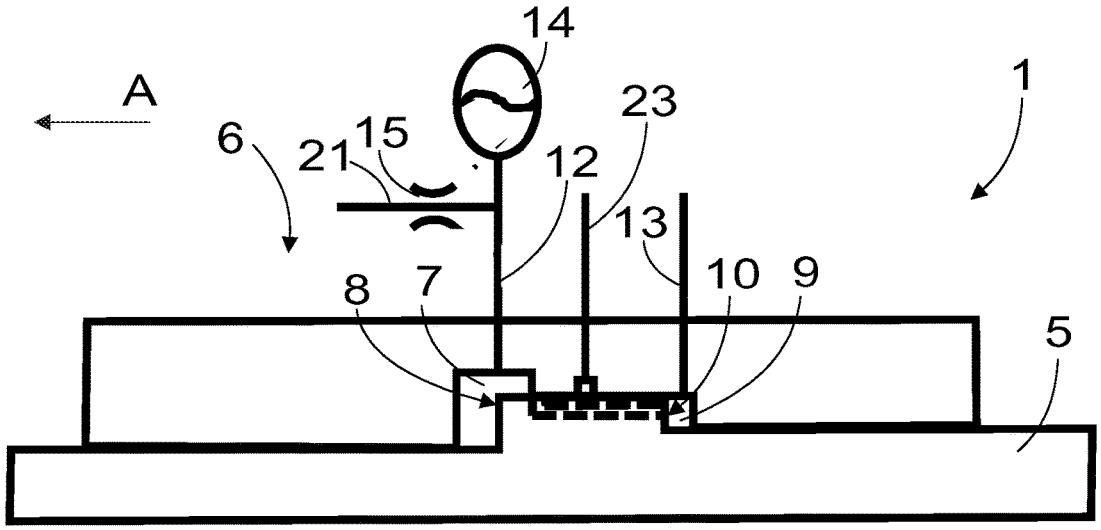
FIG. 6 illustrates a detail of a rock drill according to a sixth embodiment.

FIG. 6 illustrates a detail of a rock drill according to a sixth embodiment. A rock drill 1 may have a fifth pressure channel 23 provided in the frame 6 on an area between the first pressure space 7 and the second pressure space 9. Such a fifth pressure channel 23 may be provided for one or several of different purposes depending on the embodiment and depending on the structure of the rock drill 1. In the embodiment of FIG. 6, the fifth pressure channel 23 is provided to prevent leakage flow from the second pressure space 9 to the first pressure space 7 or vice versa, in other words in the opposite direction from the first pressure space 7 to the second pressure space 9.

Figure 7:
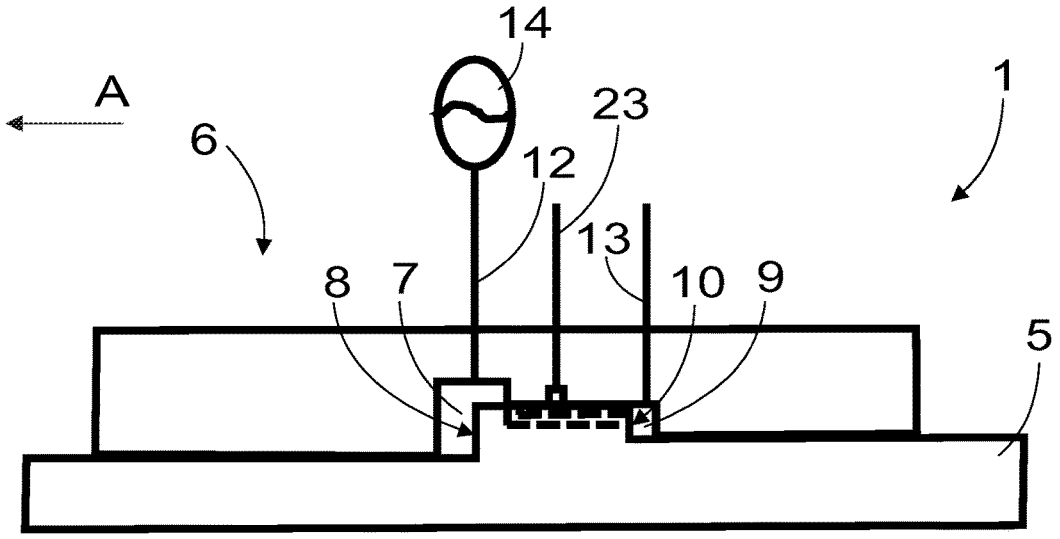
FIG. 7 illustrates a detail of a rock drill according to a seventh embodiment.

FIG. 7 illustrates a detail of a rock drill 1 according to a seventh embodiment. According to this embodiment, the flow of the pressure medium outwards from the first pressure space 7 may be throttled by a clearance between the axial sleeve 5 and the frame 6 provided on an area between the first pressure space 7 and the fifth pressure channel 23, in other words on an area towards the second pressure space 9 from the first pressure space 7. Thus, in such an embodiment an external throttle, such as a first throttle 15, is not necessary. Otherwise, the rock drill 1 and its structure and working principle may be similar to any one of the preceding embodiments or a combination thereof, such as those of the embodiments of FIG. 1, FIG. 4 and/or FIG. 5, for example.

Figure 8:
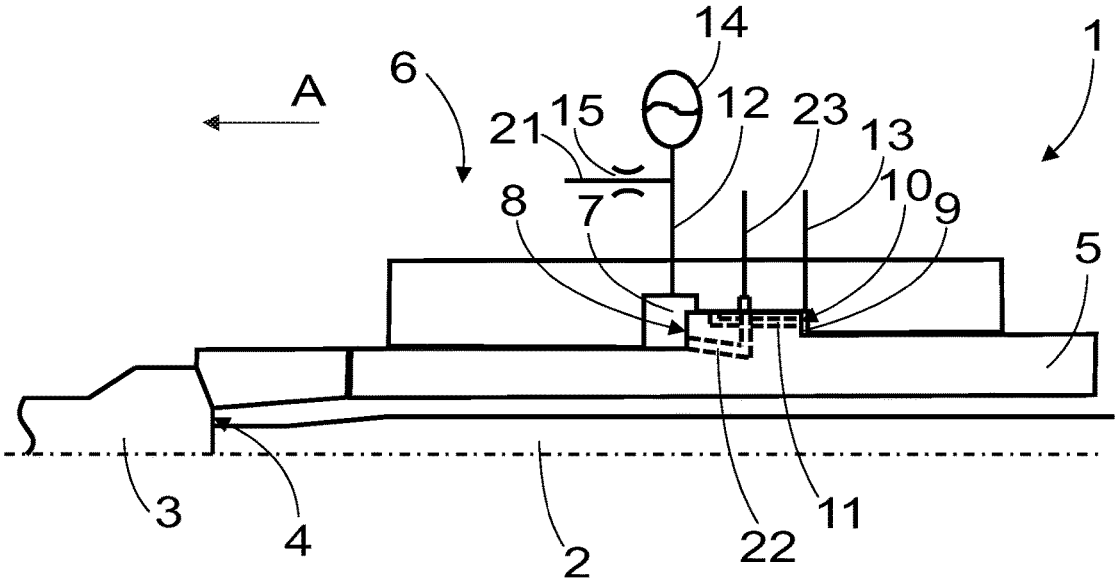
FIG. 8 illustrates a detail of a rock drill according to an eighth embodiment.

FIG. 8 illustrates a detail of a rock drill according to an eighth embodiment. The axial sleeve 5 may be provided with a second channel 22, which second channel 22 connects the first pressure space 7 and the fifth pressure channel 23 when the axial sleeve 5 has moved from the normal use position of the axial sleeve 5 towards a direction opposite in relation to the shank 3, in other words when the axial sleeve 5 has moved from the normal use position of the axial sleeve 5 away from the shank 3. The fifth pressure channel 23 may be connected to a side of the axial sleeve 5 on an area between the first pressure space 7 and the second pressure space 9. Thereby, the pressure accumulator 14 can be emptied quickly and the pressure in the first pressure space 7 may be decreased quickly in such a situation, whereby the thrust of the axial sleeve 5 increases returning the axial sleeve 5 back to its normal position in relation to the frame 6.

FIG. 9 illustrates a detail of a rock drill according to a ninth embodiment. In this embodiment, the fourth pressure channel 21 may be directly connected to the first pressure space 7. Otherwise, the rock drill 1 and its structure and working principle may be similar to any one of the preceding embodiments or a combination thereof, such as the embodiments of FIG. 1 to FIG. 8, for example.

According to an embodiment, the third pressure channel 16, the fourth pressure channel 21 and/or the fifth pressure channel 23 may be connected to a tank 20. In other words, the first pressure space 7 may be connected to a tank 20 through the first pressure channel 12, the third pressure channel 16, the fourth pressure channel 21 and/or the fifth pressure channel 23. According to a further embodiment, the first pressure space 7 may be connected through the first pressure channel 12, the third pressure channel 16, the fourth pressure channel 21 and/or the fifth pressure channel 23 to a pressure lower than that of the external pressure connected to the second pressure space 9 instead of or in addition to being connected to the tank 20.

According to an embodiment, the flow of the pressure medium outwards from the first pressure space 7 is throttled by throttling the flow of the pressure fluid from the first pressure space 7 to the tank 20 and/or the pressure lower than that of the external pressure connected to the second pressure space 9. As explained above, the throttling may be provided by a first throttle 15 provided in a fourth pressure channel 21 or by a clearance between the axial sleeve 5 and the frame 6. The throttled channel, which, depending on the embodiment, may be the third pressure channel 16, the fourth pressure channel 21 and/or the fifth pressure channel 23, may be connected to the first pressure space 7 directly or indirectly via another channel, such as via the first pressure channel 12.

According to an embodiment there is no throttling or at least no substantial amount of throttling capable of affecting the operation of the rock drill 1, between the first pressure space 7 and the pressure accumulator 14. In other words, the connection between the first pressure space 7 and the pressure accumulator is substantially not throttled. In other words, the pressure fluid is enabled to flow substantially in a substantially unthrottled manner from the first pressure space 7 to the pressure accumulator 14 directly or through the first pressure channel 12.

According to an embodiment, the rock drill 1 is a hydraulically driven rock drill and the pressure medium comprises a hydraulic fluid.

It will be obvious to a person skilled in the art that, as the technology advances, the inventive concept can be implemented in various ways. The invention and its embodiments are not limited to the examples described above but may vary within the scope of the claims.

The invention claimed is:

1. A rock drill comprising at least:

a frame;

a percussion member for generating impact pulses;

an axial shank provided on a front side of the percussion member in a direction of an impact and including an impact surface for receiving said impact pulses;

an axial sleeve provided within the frame and including a first pressure surface facing towards the shank provided in a first pressure space and a second pressure surface facing away from the shank provided in a second pressure space, wherein the first pressure space is provided in an axial direction on a side of the shank in relation to the axial sleeve and the second pressure space is provided in an axial direction on the side of the axial sleeve opposite to that of the shank, and wherein pressure medium fed to said pressure spaces is arrangeable to act on the first pressure surface and/or on the second pressure surface for moving the axial sleeve in the axial direction;

a first channel provided in the axial sleeve, which first channel provides a connection between the first pressure space and the second pressure space in at least one position of the axial sleeve in the frame;

a second pressure channel connected to the second pressure space, which second pressure channel is connectable to external pressure; and a pressure accumulator is connected to the first pressure space and that flow of the pressure medium outwards from the first pressure space is throttled by throttling the flow of the pressure medium from the first pressure space to a tank and/or the pressure lower than that of the external pressure connected to the second pressure space.

2. The rock drill according to claim 1, further comprising a first pressure channel extending between the first pressure space and the pressure accumulator, and a fourth pressure channel connected to the first pressure space directly or indirectly and provided with a first throttle for throttling the flow of the pressure medium outwards from the first pressure space.

3. The rock drill according to claim 1, wherein an area of the second pressure surface is smaller in size than an area of the first pressure surface.

4. The rock drill according to any claim 1, wherein the flow of the pressure medium outwards from the first pressure space is throttled by dimensioning a clearance between the axial sleeve and the frame to throttle leakage flow between the axial sleeve and the frame.

5. The rock drill according to claim 4, wherein on a side of the axial sleeve in the direction of the shank from the first pressure space there is connected a third pressure channel for arranged to receive leakage flow the clearance between the axial sleeve and the frame.

6. The rock drill according to claim 1, wherein a fifth pressure channel is provided in the frame in an area between the first pressure space and the second pressure space.

7. The rock drill according to claim 6, wherein the fifth pressure channel is provided to prevent leakage flow from the second pressure space to the first pressure space and vice versa.

8. The rock drill according to claim 6, wherein the axial sleeve is provided with a second channel, which second channel connects the first pressure space and the fifth pressure channel when the axial sleeve has moved from the normal use position of the axial sleeve towards a direction opposite in relation to the shank, and wherein the fifth pressure channel is connected to a side of the axial sleeve on an area between the first pressure space and the second pressure space.

9. The rock drill according to claim 1, wherein a seal is provided in the axial sleeve or in the frame in an area between the first pressure space and the second pressure space to prevent leakage flow from the second pressure space to the first pressure space and vice versa.

10. The rock drill according to claim 1, wherein a second throttle is provided in the second pressure channel.

11. The rock drill according to claim 10, wherein a non-return valve is provided in the second pressure channel connected and in parallel with said second throttle, such that the non-return valve enables flow of the pressure medium in to the second pressure space but not outwards from the second pressure space, whereby flow of the pressure medium outwards from the second pressure space can only take place through the second throttle.

12. The rock drill according to claim 1, wherein the first pressure space is connected to the tank through the first pressure channel, the third pressure channel 464, the fourth pressure channel and/or the fifth pressure channel.

* * * * *